US011850624B2

(12) United States Patent
Schöck et al.

(10) Patent No.: US 11,850,624 B2
(45) Date of Patent: Dec. 26, 2023

(54) DISTRIBUTOR HEAD FOR A DISTRIBUTOR APPARATUS AND DISTRIBUTOR APPARATUS

(71) Applicant: Sulzer Mixpac AG, Haag (CH)

(72) Inventors: Joachim Schöck, Winterthur (CH); Matt Lyndon, Chandlers Ford (GB)

(73) Assignee: MEDMIX SWITZERLAND AG, Haag (CH)

( * ) Notice: Subject to any disclaimer, the term of this patent is extended or adjusted under 35 U.S.C. 154(b) by 9 days.

(21) Appl. No.: 17/442,707

(22) PCT Filed: Feb. 5, 2020

(86) PCT No.: PCT/EP2020/052876
§ 371 (c)(1),
(2) Date: Sep. 24, 2021

(87) PCT Pub. No.: WO2020/192989
PCT Pub. Date: Oct. 1, 2020

(65) Prior Publication Data

US 2022/0143646 A1 May 12, 2022

(30) Foreign Application Priority Data

Mar. 25, 2019 (DE) ..... 20 2019 101 681.7

(51) Int. Cl.
*B05C 17/005* (2006.01)

(52) U.S. Cl.
CPC .. *B05C 17/00516* (2013.01); *B05C 17/00589* (2013.01); *B05C 17/00503* (2013.01)

(58) Field of Classification Search
CPC ..... B05C 17/00516; B05C 17/00589; B05C 17/005; B05C 17/00503; B05C 17/0052
(Continued)

(56) References Cited

U.S. PATENT DOCUMENTS 3,182,867 A 5/1965 Barosko et al.
4,622,239 A 11/1986 Schoenthaler et al.
(Continued)

FOREIGN PATENT DOCUMENTS

CA 2822483 A1 7/2012
CN 1750889 A 3/2006
(Continued)

OTHER PUBLICATIONS

International Search Report dated May 28, 2020 in corresponding International Patent Application No. PCT/EP2020/052876, filed Feb. 5, 2020 (with English Translation).

*Primary Examiner* — David J Walczak
(74) *Attorney, Agent, or Firm* — GLOBAL IP COUNSELORS, LLP

(57) ABSTRACT

A distributor head for a distributor apparatus for distributing fluids onto a surface includes an elongate base element having a fluid volume to receive the fluid, a filling opening connected in a fluid-communicating manner to the fluid volume to fill the fluid into the fluid volume, and a plurality of distributor openings connected in a fluid-communicating manner to the fluid volume to distribute the fluid from the fluid volume. The filling opening arranged at a first longitudinal side of the distributor head and the plurality of distributor openings arranged at a second longitudinal side of the distributor head, the first longitudinal side arranged opposite the second longitudinal side, and the plurality of distributor openings continuously formed in a wall of the base element.

19 Claims, 9 Drawing Sheets

(58) Field of Classification Search
USPC ..... 401/44–48, 261–267
See application file for complete search history.

(56) References Cited

U.S. PATENT DOCUMENTS

| | | | |
|---|---|---|---|
| 5,516,273 | A | 5/1996 | Delmore et al. |
| 5,733,980 | A | 3/1998 | Cozewith et al. |
| 5,882,133 | A | 3/1999 | Chao et al. |
| 6,089,407 | A | 7/2000 | Gardos |
| 6,981,611 | B2 | 1/2006 | Carruth et al. |
| 8,430,588 | B2 | 4/2013 | Haack |
| 8,974,133 | B2 | 3/2015 | Schreitter Ritter von Schwarzenfeld |
| 9,498,792 | B2 | 11/2016 | Miller et al. |
| 9,713,821 | B2 | 7/2017 | Liao |
| 2002/0121239 | A1 | 9/2002 | Tonazzi et al. |
| 2005/0135869 | A1 | 6/2005 | Liberatore |
| 2006/0118580 | A1 | 6/2006 | Spencer |
| 2007/0189839 | A1* | 8/2007 | King ..... A61M 35/003 401/265 |
| 2009/0266295 | A1 | 10/2009 | Saunders |
| 2011/0003082 | A1 | 1/2011 | Schoen et al. |
| 2011/0061589 | A1 | 3/2011 | Ando et al. |
| 2011/0248053 | A1 | 10/2011 | Ritter von Schwarzenfeld |
| 2012/0048893 | A1 | 3/2012 | Beckett |
| 2012/0121315 | A1 | 5/2012 | Haack |
| 2012/0121803 | A1 | 5/2012 | Pahl et al. |
| 2013/0279967 | A1 | 10/2013 | Otto |

FOREIGN PATENT DOCUMENTS

| | | | |
|---|---|---|---|
| CN | 1826181 | A | 8/2006 |
| CN | 101791607 | A | 8/2010 |
| CN | 103706513 | B | 4/2018 |
| DE | 2 101 800 | A1 | 7/1972 |
| DE | 101 25 666 | A1 | 9/2002 |
| DE | 20 2010 001 508 | U1 | 5/2010 |
| DE | 20 2010 011 769 | U1 | 11/2010 |
| DE | 10 2009 034 774 | A1 | 1/2011 |
| DE | 10 2013 219 628 | B4 | 8/2016 |
| EP | 1 749 586 | A1 | 2/2007 |
| EP | 2 591 863 | A2 | 5/2013 |
| EP | 1 729 890 | B1 | 9/2014 |
| EP | 3 338 900 | A1 | 6/2018 |
| JP | H10174905 | A | 6/1998 |
| JP | H10192762 | A | 7/1998 |
| JP | H10296132 | A | 11/1998 |
| JP | 3270763 | B2 | 4/2002 |
| JP | 2004025121 | A | 1/2004 |
| JP | 2006513859 | A | 4/2006 |
| JP | 5074072 | B2 | 11/2012 |
| JP | 5309308 | B2 | 10/2013 |
| KR | 200427086 | Y1 | 9/2006 |
| KR | 100867893 | B1 | 11/2008 |
| KR | 101703383 | B1 | 2/2017 |
| NL | 1025695 | C2 | 9/2005 |
| WO | 2004/065023 | A1 | 8/2004 |
| WO | 2005/087386 | A1 | 9/2005 |
| WO | 2008/058911 | A1 | 5/2008 |

* cited by examiner

DISTRIBUTOR HEAD FOR A DISTRIBUTOR APPARATUS AND DISTRIBUTOR APPARATUS

CROSS-REFERENCE TO RELATED APPLICATIONS

This application is a U.S. National Stage application of International Application No. PCT/EP2020/052876, filed Feb. 5, 2020, which claims priority to German Patent Application No. 20 2019 101 681.7, filed Mar. 25, 2019, the contents of which are hereby incorporated herein by reference.

BACKGROUND

Field of the Invention

The present invention relates to a distributor head for a distributor apparatus for distributing fluids, in particular for distributing liquid adhesives and/or adhesive agents, onto a surface, preferably onto a substrate surface. The present invention further relates to a distributor apparatus comprising such a distributor head.

Background Information

Conventional distributor apparatuses and corresponding distributor heads for these distributor apparatus are generally known. Such conventional distributor apparatuses are, for example, used to apply fluids, in particular highly viscous fluids, such as liquid adhesives and/or adhesive agents, to surfaces. In general, such a distributor apparatus usually has a provision element, in which the fluid to be distributed is stored or provided, and additionally a specific distributor head by which the actual distribution of the fluid is performed. On the distribution of the fluid, it is introduced from the provision element into a distributor head of the distributor apparatus and is distributed on the surface by the distributor head, wherein the fluid can in particular be provided distributed over a larger width by the distributor head. A distribution of the fluid on a large surface can thereby take place in a time-saving manner. For this purpose, the fluid introduced into the distributor head is often distributed therein divided between a large number of distributor openings, which are usually arranged next to one another, and an at least approximately areal distribution of the fluid on the surface is made possible in this manner.

SUMMARY

As already described above, the fluid is introduced into the distributor head and fanned out in therein to a larger width for a distribution on the surface. For the distribution of the fluid within the distributor head, the distributor head usually has a fluid volume, i.e. a hollow space for receiving fluid, to which both a filling opening for filling the fluid into the fluid volume and the distributor openings are connected in a fluid-communicating manner. It has been found to be disadvantageous in this respect that, at least at the start of the filling of the fluid into the fluid volume, a uniform or at least substantially uniform fluid distribution does not occur upon the discharge of the fluid through the distributor openings onto the surface. This is due to the fact that the fluid in the fluid volume of the distributor head is initially only present in a localized manner near the filling opening and thus not all the distributor openings can be sufficiently supplied with fluid to distribute the fluid on the surface. This can at least initially lead to the above-described irregularities in the fluid distribution on the surface. In the subsequent operation of the distributor apparatus, pressure distributions present in the fluid can likewise lead to such irregularities. A uniform application of the fluid to the surface over the total width of the distributor head can thus not be ensured.

It is an object of embodiments of the present invention to overcome, at least in part, the disadvantages described above. It is in particular an object of embodiments of the present invention to provide a distributor head and a distributor apparatus which in a particularly simple manner ensures a uniform or at least substantially uniform fluid distribution upon the discharge of the fluid onto a surface over at least substantially the total distribution time and/or the total distribution width of the distributor head on a distribution of the fluid onto the surface.

The object above can be satisfied by a distributor head having the features described herein and by a distributor apparatus having the features described herein. Further features and advantages of the present invention can be seen in the description, and the drawings. Advantages and features that are described in connection with the distributor head in accordance with embodiments of the invention in this respect naturally also apply in connection with the distributor apparatus in accordance with embodiments of the invention and vice versa in each case so that mutual reference is or can always be made to the individual invention aspects.

In accordance with a first aspect of the invention, the object is satisfied by a distributor head for a distributor apparatus for distributing fluids, in particular for distributing liquid adhesives and/or adhesive agents, onto a surface, preferably onto a substrate surface, wherein the distributor head has:

a. an elongate base element having a fluid volume for receiving the fluid;

b. at least one filling opening, which is connected in a fluid-communicating manner to the fluid volume, for filling the fluid into the fluid volume; and c. at least one distributor opening, which is connected in a fluid-communicating manner to the fluid volume, for distributing the fluid from the fluid volume, wherein the at least one filling opening is arranged at a first longitudinal side of the distributor head and at least one distributor opening is arranged at a second longitudinal side of the distributor head, wherein the first longitudinal side is preferably arranged opposite the second longitudinal side, wherein furthermore the at least one distributor opening is continuously formed in a wall of the base element with a defined length and a defined width in each case, wherein i. the at least one distributor opening is formed by a plurality of distributor openings, wherein the plurality of distributor openings are arranged adjacent to one another and the lengths of the distributor openings along a flow direction of the fluid and/or the widths of the distributor openings transverse to the flow direction of the fluid distributor openings are formed in a varying manner over the plurality of distributor openings for a uniform or at least substantially uniform fluid distribution on the surface on the distribution of the fluid, and/or ii. at least one of the at least one distributor openings is formed as a slot-like distributor opening, wherein the slot-like distributor opening extends along a longitudinal direction of the second longitudinal side and the length of the slot-like distributor opening along a flow direction of the fluid and/or the width of the slot-like distributor opening transverse to the flow direction of the fluid and transverse to the longitudinal direction of the second longitudinal side are formed in a varying manner for a uniform or at least substantially uniform fluid distribution on the surface on the distribution of the fluid, and/or iii. distribution elements for a uniform or at least substantially uniform distribution of the fluid in the fluid volume are arranged in the fluid volume for a uniform or at least substantially uniform fluid distribution on the surface on the distribution of the fluid through the at least one distributor opening.

Fluids can be uniformly distributed on a surface by a distributor head in accordance with embodiments of the invention as part of a distributor apparatus. The distributor head in particular has an elongate base element in which a fluid volume is arranged in which the fluid can be received in the interior of the distributor head. The fluid can be introduced into the fluid volume of the distributor head by the remaining components of a distributor apparatus, for example, a provision element for providing the fluid to be distributed. For this purpose, the distributor head has a filling opening that is connected in a fluid-communicating manner to the fluid volume. In addition to a single filling opening, two or more such filling openings can also be provided.

To be able to discharge the fluid from the distributor head and apply it to a surface, at least one distributor opening is in turn connected in a fluid-communicating manner to the fluid volume, whereby an exiting or discharge of the fluid from the fluid volume onto the surface can be achieved. For example, a liquid adhesive and/or an adhesive agent, in particular a liquid adhesive and/or an adhesive agent having a high viscosity, can preferably be used as a fluid in the distributor head in accordance with the invention.

Each of the at least one distributor openings represents an opening in a wall of the fluid volume and has a length and a width. In accordance with embodiments of the invention, the length of the respective distributor opening is understood as a length flowed through by the fluid along a flow direction of the fluid in the distributor opening. For example, the length of the respective distributor opening can correspond to a wall thickness of the wall of the fluid volume at the location of the distributor opening. A width of the respective distributor opening in the sense of the invention is a clear width of the distributor opening transverse to the length flowed through. In the case of slot-like distributor openings which, in accordance with the invention, are expanded in a slot-like or gap-like manner along a longitudinal direction of the second longitudinal side, the width of this distributor opening in the sense of the invention is additionally oriented transversely to the slot-like extent of this distributor opening in addition to the orientation transverse to the flow direction or to the length flowed through. In particular, these slot-like distributor openings can preferably be considered as a continuous row arrangement of possible exit locations, wherein each of these exit locations can have an individual length and/or width.

To ensure as simple as possible a distribution of the fluid for a discharge onto the surface, provision is made that the at least one distributor opening is arranged in a second longitudinal side of the distributor head. A discharge or distribution of the fluid via the at least one distributor opening onto the surface is particularly easily made possible in this manner.

The filling opening for introducing the fluid into the fluid volume can preferably be arranged in a first longitudinal side that is arranged disposed opposite the second longitudinal side. In other words, the fluid is introduced into the fluid volume through the filling opening on a first longitudinal side of the base element or of the fluid volume, is distributed in the fluid volume, and is subsequently distributed on the surface via the at least one distributor opening arranged in the second longitudinal side. An internal distribution of the fluid in the fluid volume can thus be achieved particularly easily and effectively by this arrangement of the filling opening in the first longitudinal side and of the plurality of distributor openings in the second longitudinal side.

In accordance with embodiments of the invention, provisions can be made such that the at least one distributor opening is continuously formed in a wall of the base element. Continuous in the sense of the embodiments of the invention in particular means that a first open end of the at least one distributor opening is connected in a fluid-communicating manner to the fluid volume and a second open end of the at least one distributor opening is connected in a fluid-communicating manner to an environment of the distributor head. A discharge or distribution of the fluid through the at least one distributor opening can be particularly simply ensured in this manner.

In a first embodiment variant of a distributor head in accordance with the invention, the at least one distributor opening is formed by a plurality of distributor openings, wherein the plurality of distributor openings are arranged adjacent to one another, particularly preferably linearly next to one another. Furthermore, the individual distributor openings in the wall of the base element each have a defined length along a flow direction of the fluid and a defined width transverse to the corresponding flow direction of the fluid. Such a defined width can, for example, be a diameter of a cylindrical or tubular distributor opening. In accordance with the invention, provision is made that these lengths and/or widths of the distributor openings are not the same for all the distributor openings, but are formed in a varying manner over the plurality of distributor openings. In this respect, the fact is in particular utilized that the flow resistance through distributor openings having a larger length and/or a smaller width is higher than in the case of shorter or wider distributor openings. In other words, more fluid can be discharged through a shorter and/or wider distributor opening than through a distributor opening having a larger length and/or a smaller width under otherwise the same conditions. It can thereby be taken into account that the fluid within the distributor head has to cover different distances from the filling opening up to the distributor openings. A uniform or at least substantially uniform discharge of the fluid via the plurality of distributor openings on the application to the surface can also be made possible under different conditions in the distributor head and/or in the fluid. Overall, this varying can be provided such that a uniform or at least substantially uniform fluid distribution can be produced on the discharge or distribution of the fluid on the surface, preferably over the total duration of this process.

In this respect, it is, for example, taken into account that the fluid is present in the fluid volume with an internal pressure distribution, in particular due to the flow behavior of the fluid in the fluid volume. This pressure distribution, in particular the pressure in the fluid at the connection point of the respective distributor opening with the fluid volume, is in particular decisive for a quantity of fluid that exits through the respective distributor opening. For example, at distributor openings which are disposed opposite the at least one filling opening and in which the flow direction of the fluid is thus at least similar to the flow direction of the fluid entering into the fluid volume, a higher pressure will be present than at distributor openings that are arranged further remote from the at least one filling opening, whereby the flow direction of the fluid in the respective distributor opening is increasingly oriented transversely to the flow direction of the fluid in the fluid volume. In the following, this pressure behavior of the fluid in the fluid volume is also designated as an "effective pressure". At a high effective pressure, more fluid, however, exits from the respective distributor opening in the same unit of time than would exit at a low effective pressure. To achieve a uniform or at least substantially uniform fluid distribution on the surface on the distribution of the fluid, provision can in particular be made that the varying of the lengths and/or widths of the distributor opening is performed such that precisely these different pressure distributions in the fluid volume are thereby compensated. Overall, a uniform application of the fluid to the surface can be provided in this manner.

Alternatively or additionally, such a uniform application of the fluid to the surface can also be provided in that at least one of the at least one distributor openings is formed as a slot-like distributor opening, wherein the slot-like distributor opening extends along a longitudinal direction of the second longitudinal side and a length of the slot-like distributor opening along a flow direction of the fluid and/or a width of the slot-like distributor opening transverse to the flow direction of the fluid and transverse to the longitudinal direction of the second longitudinal side is/are formed in a varying manner for a uniform or at least substantially uniform fluid distribution on the surface on the distribution of the fluid. In other words, this at least one distributor opening extends as a slot-like opening along the longitudinal direction of the second longitudinal side and thus provides the fluid with a continuous row arrangement of exit locations along the longitudinal direction. Thus, such a slot-like distributor opening can also be considered as an amalgamation of a plurality of distributor openings that merge directly into one another as they have been described above and that have all the features and advantages listed there. A single slot-like distributor opening of such a kind is particularly preferably provided and extends over the total length or at least substantially the total length of the second longitudinal side of the distributor head. In accordance with embodiments of the invention, a provision can be made that a length of the slot-like distributor opening along a flow direction of the fluid in the distributor opening and/or a width of the slot-like distributor opening transverse to the flow direction of the fluid and transverse to the longitudinal direction of the distributor opening in particular changes/change such that the above-described differences in the flow of the fluid in the fluid volume, for example with respect to a distance to be covered between the filling opening and the respective exit location of the fluid through the slot-like distributor opening or with respect to pressure conditions and/or flow rates in the fluid, can thereby be compensated. Thus, a uniform application of the fluid to the surface can also be provided in this embodiment of a distributor head in accordance with the invention.

Alternatively or additionally, distribution elements for a uniform or at least substantially uniform distribution of the fluid in the fluid volume can be arranged within the fluid volume for a uniform or at least substantially uniform fluid distribution on the surface on the distribution of the fluid through the at least one distributor opening. Such distribution elements can, for example, be designed as guide surfaces, passages, and/or also as blocking elements for a targeted conducting of a flow of fluid in the fluid volume. Due to a corresponding use of such distribution elements within the fluid volume, the above-described differences in the flow of the fluid in the fluid volume, for example with respect to a distance to be covered between the filling opening and the respective exit location of the fluid through the at least one distributor opening or with respect to pressure conditions and/or flow rates in the fluid, can already be compensated or at least considerably reduced within the fluid volume. A uniform application of the fluid to the surface can thus also be provided or at least considerably facilitated or improved by such distribution elements.

A distributor head in accordance with embodiments of the invention can preferably be configured such that the length and/or the width of the at least one distributor opening is/are formed in a varying manner adapted to the position of the at least one filling opening. The above-described pressure distribution in the fluid is in particular formed in dependence on the position of the at least one filling opening in the fluid volume. An adaptation of the length and/or of the width of the at least one distributor opening, irrespectively of whether it is a distributor opening of a plurality of distributor openings or a design of a slot-like distributor opening at one or more exit locations, to this very position of the at least one filling opening can thus particularly easily effect the necessary variation of the length and/or width of the at least one distributor opening for compensating the different effective pressures within the fluid present in the fluid volume. An at least partly incomplete filling of the fluid volume with fluid at the start of the use of a distributor head in accordance with the invention can also be compensated or at least partly compensated in this manner by a correspondingly provided variation of the length and/or width of the at least one distributor opening.

Furthermore, a distributor head in accordance with embodiments of the invention can be configured such that the length and/or the width of the at least one distributor opening is/are formed in a varying manner adapted to a spacing between the at least one filling opening and the respective distributor opening. A spacing between the respective at least one filling opening and the position of the corresponding distributor opening or of an exit location of a distributor opening, at which a length and/or a width of the distributor opening is/are to be varied, can be used to determine the above-described pressure distribution in the fluid in the fluid volume or to estimate it at least approximately. A taking into account of this spacing can thus be used in a particularly simple manner to determine the necessary variation of the lengths and/or widths of the at least one distributor opening, irrespectively of whether it is a distributor opening of a plurality of distributor openings or a design of a slot-like distributor opening at one or more exit locations.

Provisions can particularly preferably be made in a distributor head in accordance with the invention that the length of the at least one distributor opening is formed as decreasing as the spacing between the at least one filling opening and the respective distributor opening increases. The pressure distribution within the fluid volume is usually formed such that the pressure is highest at the locations of the at least one distributor opening in the fluid close to the filling opening. In other words, this pressure in the fluid decreases as the spacing from the filling opening increases. As already described above, this can, for example, be attributed to an increasing angle between a direction of flow of the fluid in the fluid volume and the at least one distributor opening arranged at the corresponding distance. To compensate this, a provision can particularly preferably be made that the respective length of the at least one distributor opening become shorter as the spacing from the at least one filling opening increases. In other words, in the case of a plurality of distributor openings, the lengths of the distributor openings that are arranged further remote from the at least one filling opening are, for example, shorter than the lengths of the distributor openings that are arranged closer to the at least one filling opening. In the case of an at least one distributor opening preferably formed in a slot-like manner in the direction of a longitudinal extent of the second longitudinal side, a length flowed through can correspondingly change for different exit locations of the fluid through the slot-like distributor opening such that the length flowed through decreases as the spacing of the respective exit location from the at least one filling opening increases. Fluid that enters at a high pressure into the corresponding distributor opening near the filling opening thus has to cover a further distance in the respective distributor opening or at the respective exit location within the slot-like distributor opening, whereby a discharge of the fluid through this specific distributor opening or at this specific exit location is delayed. Far away from the filling opening, the pressure in the fluid is indeed lower, but the length of the corresponding distributor opening or a length at the corresponding exit location within the slot-like distributor opening is correspondingly shortened. In this way, in particular the uniform fluid distribution on the surface can thus be ensured on the distribution of the fluid.

Alternatively or additionally, in a distributor head in accordance with the invention, a provision can be made that the width of the at least one distributor opening is formed as increasing as the spacing between the at least one filling opening and the respective distributor opening increases. For the widths of the distributor openings, exactly the opposite requirements apply as for the above-described lengths of the distributor openings. Particularly narrow distributor openings, i.e. distributor openings or exit locations within a slot-like distributor opening having a small width, oppose a flow of the fluid with a high resistance, in contrast to wide distributor openings or exit locations within a slot-like distributor opening having a large width that oppose the respective fluid with a lower resistance. For example in the case of a plurality of distributor openings, due to narrow distributor openings having a small width near the filling opening, a high effective pressure in the fluid at these positions can thus be compensated. At the same time, due to a large width of the distributor openings further remote from the filling opening, a low effective pressure present there in the fluid can be compensated. In the case of a slot-like at least one distributor opening, a width of the distributor opening transverse to the fluid direction and transverse to the longitudinal extent along the longitudinal extent of the slot-like distributor opening can change accordingly such that the width likewise increases as the spacing of the respective exit location of the fluid through the slot-like distributor opening from the at least one filling opening increases. This also results in a uniform or at least substantially uniform fluid distribution on the surface on the distribution of the fluid.

Furthermore, a distributor head in accordance with the invention can be configured such that the distributor head has two, three or more filling openings, wherein the two, three or more filling openings are preferably arranged in the first longitudinal side of the distributor head. Fluid can be simultaneously introduced into the fluid volume at two, three or more locations in this manner. Overall, a more uniform pressure distribution in the fluid volume already results in this manner than on an introduction of the fluid into the fluid volume only through a single filling opening. A spacing of the individual distributor openings of a plurality of distributor openings from the filling opening disposed closest thereto can, for example, in particular also be reduced in this manner, whereby differences in the effective pressure at the locations of the respective distributor opening can likewise be reduced. A provision can, for example, also be made that respective different fluids are introduced via the at least two filling openings into the fluid volume and first mix there. A particularly wide range of possible fluids for use in a distributor head in accordance with embodiments of the invention of a distributor apparatus can be made possible in this manner. The respective spacings from the two or more filling openings can preferably be taken into account in the above-described dependence of the lengths and/or widths of the at least one distributor opening on a spacing from the filling opening. This can in particular be provided for distributor openings that themselves or whose exit locations in the fluid volume are arranged between two filling openings. Alternatively, a provision can also be made to vary the lengths and/or widths of the respective at least one distributor opening in each case in dependence on a spacing from the respective filling opening disposed closest thereto.

Furthermore, a distributor head in accordance with embodiments of the invention can be configured such that the distributor head has two mutually opposite end sections as a termination of the first longitudinal side and the second longitudinal side, wherein a disk-like spacer element is arranged at each of the end sections, and wherein the disk-like spacer elements at least project over the second longitudinal side of the distributor head. In other words, these spacer elements can be used at the opposite end sections of the first longitudinal side and the second longitudinal side to place the distributor head onto the surface to be wetted with the fluid, wherein it can simultaneously be prevented that the least one distributor opening comes into contact with the surface. A defined spacing is thus maintained between the at least one distributor opening and the surface such that the fluid can exit unimpeded from the at least one distributor opening. Furthermore, contamination of the at least one distributor opening by elements of the surface can be reliably avoided in this manner.

In accordance with a preferred further development, a distributor head in accordance with an embodiment of the invention can further be configured such that the disk-like spacer element is arranged in a rotatably supported manner at the respective end section. The disk-like spacer elements can thereby act as wheels when the distributor head or the corresponding distributor apparatus is displaced, in particular linearly displaced, on the application of the fluid to the surface. A particularly safe and controlled application or distribution of the fluid to the corresponding surface can be achieved in this manner. The disk-like spacer elements can preferably be circular or cylindrical for this purpose.

A distributor head in accordance with the invention can also be present in an embodiment, wherein the base element has a triangular or at least substantially triangular cross-section transverse to the first longitudinal side and/or the second longitudinal side. In the case of such a base element with a triangular or at least substantially triangular cross-section, in particular also the fluid volume transverse to the longitudinal sides has a triangular or at least substantially triangular cross-section. In particular such a fluid volume having a triangular cross-section has proven to be particularly suitable to be able to quickly and reliably ensure a uniform distribution of the fluid in the fluid volume. Thus, the second longitudinal side can, for example, be located at and/or at least near a tip of the triangular cross-section such that a discharge of the fluid to be distributed is particularly easily possible there through the at least one distributor opening arranged in the second longitudinal side. Conversely, the first longitudinal side can be arranged in one of the sides, preferably at the center of one of the sides, of the triangular or at least substantially triangular cross-section. The introduction of the fluid into the fluid volume and in particular the internal distribution of the fluid in the fluid volume can thereby be achieved particularly easily. In this respect, the fact can in particular be utilized that the at least one filling opening can be formed with a particularly large free cross-section due to the arrangement of the at least one filling opening in one side of the triangular cross-section.

In accordance with a preferred further development of a distributor head in accordance with the invention, provisions can be made that the base element has a first wall element, a second wall element, and a third wall element, wherein the three wall elements are elongate and are arranged against one another, preferably connected to one another, to form the triangular or at least substantially triangular cross-section of the base element. It can be particularly easily achieved by a base element that substantially comprises three wall elements such that particularly this base element has a triangular or at least substantially triangular cross-section. To form such a cross-section, the three wall elements are arranged against one another, preferably connected to one another. This connection can particularly preferably be performed in a sealing manner to be able to provide a fluid-tight fluid volume in the interior of the base element in a particularly simple and safe manner.

In a preferred further development of a distributor head in accordance with an embodiment of the invention, provisions can be made that the first wall element and the second wall element are formed in one piece and/or monolithically and separately from the third wall element. In other words, apart from its end sections, the base element at least substantially comprises two parts, the single-piece element comprising the first and second wall elements and the third wall element provided separately therefrom. The manufacture and/or the assembly of the base element of the distributor head can be further simplified by being based on only two main elements.

In a distributor head in accordance with embodiments of the invention, provisions can furthermore preferably be made that the third wall element is connectable in a sealed manner to the first wall element and the second wall element in order to form the fluid volume. A sealed fluid volume can be particularly easily provided by a sealed connection of the third wall element to the first and second wall elements that are in turn formed in one piece and/or monolithically. A sealing of the fluid volume at the end sections can in this respect be provided either via additional elements at the end sections or by further elements that are already arranged at the third wall element or at the first and second wall elements.

A distributor head in accordance with embodiments of the invention can also be further developed such that the third wall element forms the first longitudinal side of the distributor head, and/or such that the at least one filling opening is arranged in the third wall element. The at least one filling opening of the distributor head in accordance with embodiments of the invention can, as already described above, preferably be arranged at a center of a side of the triangular or at least substantially triangular cross-section of the base element and in particular at the center of the third wall element. Due to such an embodiment of a distributor head in accordance with the invention, the preferably central positioning of the filling opening with respect to the triangular or at least substantially triangular cross-section of the base element can be made possible in a particularly simple and reliable manner.

Furthermore, provisions can preferably be made in a distributor head in accordance with embodiments of the invention that a connection region between the first wall element and the second wall element forms the second longitudinal side of the distributor head, and in particular that the at least one distributor opening is arranged in the connection region. As already described above, in the case of a triangular or at least substantially triangular cross-section of the base element and thus in particular also of the fluid volume, provisions can preferably be made that the at least one distributor opening is positioned near a tip of the triangular or at least substantially triangular cross-section. A connection region between the first wall element and the second wall element, which wall elements can in turn preferably already be formed in one piece and/or monolithically, is in particular automatically positioned at such a pointed section of the triangular or at least substantially triangular cross-section of the base element. A desired positioning of the at least one distributor opening at and/or at least near a tip of the at least substantially triangular cross-section of the base element can thus be achieved in a particularly simple manner by a design of this connection region as a second longitudinal side, which has the at least one distributor opening, or by a direct arrangement of the at least one distributor opening in the connection region.

A distributor head in accordance with an embodiment of the invention can also be configured such that the distributor head, in particular the base element, has at least one closure element for selectively at least partly closing at least one of the at least one distributor openings. In this way, it can be possible to at least partly close one or more distributor openings and thereby to exclude or at least restrict the distributor openings selectively, i.e. in a targeted and/or controlled manner, on the distribution of the fluid on the surface. A particularly demand-adapted distribution of the fluid on the surface can be achieved in this manner. Thus, it can, for example, occur at a margin of a surface that a distribution of the fluid by a distributor head in accordance with the invention is no longer necessary over its total width. This circumstance can be met by an at least part closing of the at least one distributor opening that is not required by the at least one closure element.

In accordance with a second aspect of the invention, the object is satisfied by a distributor apparatus for distributing fluids, in particular for distributing liquid adhesives and/or adhesive agents, onto a surface, preferably onto a substrate surface, having at least one distributor head in accordance with the first aspect of the invention, and a provision element for providing the fluid, wherein the provision element is connected in a fluid-communicating manner to the at least one filling opening of the distributor head. Since a distributor apparatus in accordance with the second aspect of the invention has a distributor head in accordance with the first aspect of the invention, a distributor apparatus in accordance with the invention in accordance with the second aspect of the invention has all the advantages that have already been described in detail with respect to a distributor head in accordance with the first aspect of the invention.

BRIEF DESCRIPTION OF THE FIGURES

The invention will be explained in more detail hereinafter with reference to the drawings.

DETAILED DESCRIPTION

Figure 1:
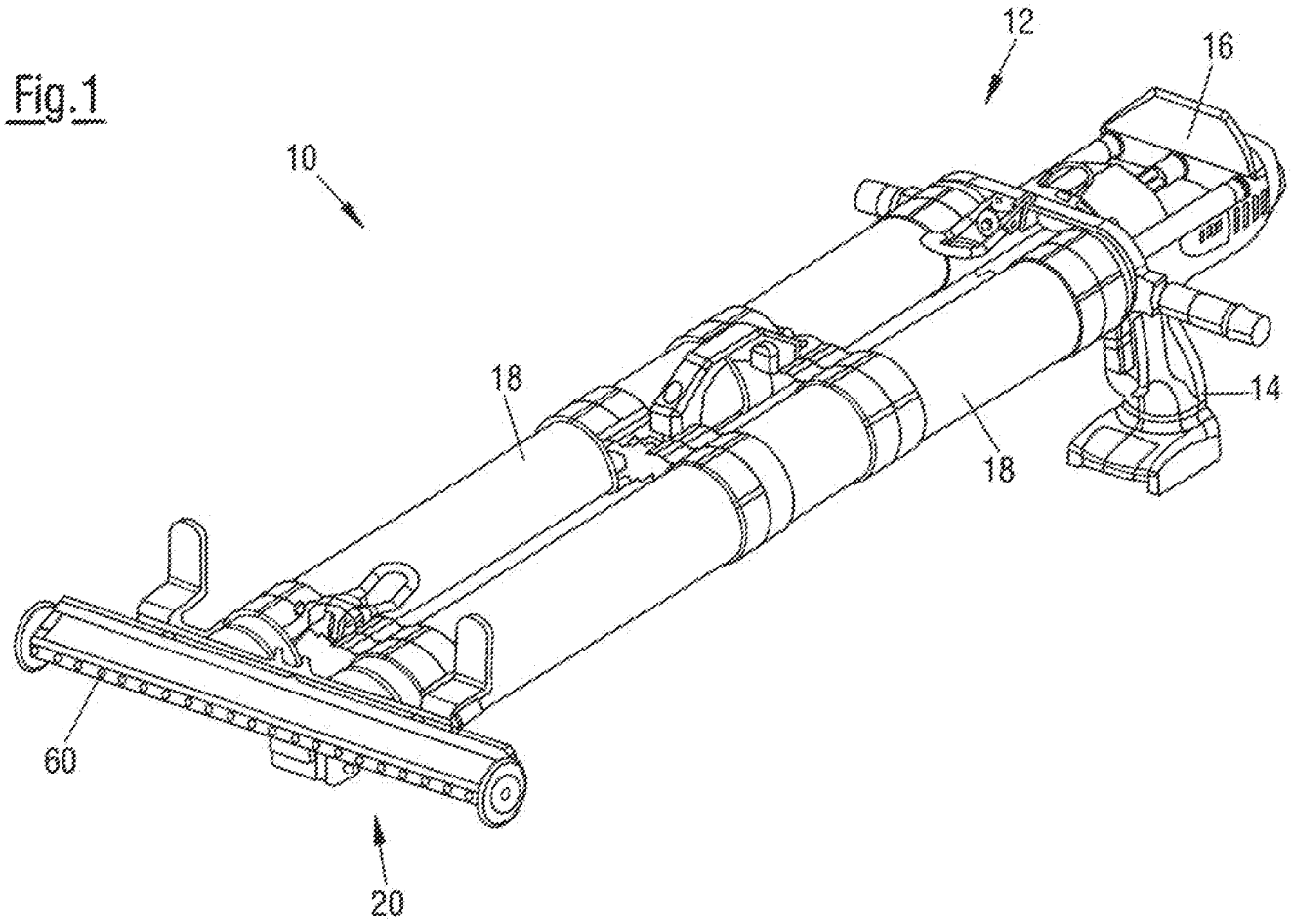
FIG. 1 is a distributor apparatus in accordance with an embodiment of the invention.

FIG. 1 shows an embodiment of a distributor apparatus 10 in accordance with the invention. The distributor apparatus 10 has a provision element 12 for providing a fluid 70 (see FIGS. 6 and 7) from fluid containers 18 and a corresponding distributor head 20 in accordance with the invention that is in turn provided for the actual distribution of the fluid 70 over a larger width. The distributor apparatus 10 in particular has two fluid containers 18 that are connected in a fluid-communicating manner to the distributor head 20. As shown, the fluid containers 18 can be formed by tubular and/or cylindrical housing elements, wherein these housing elements can preferably be removably fastened to the remainder of the distributor apparatus 10. In this respect, it is possible that the fluid containers 18 directly contain the fluid 70 or that separate fluid packings 19 (see FIG. 6), in particular in the form of flexible bags, are arranged in the fluid containers 18 for receiving the fluid. In the latter case, full fluid packings 19 can be inserted into the hollow fluid containers 18 of the distributor apparatus 10 prior to use of the distributor apparatus. After the emptying of the fluid packings 19, they can be removed from the fluid containers 18 and can either be refilled or disposed of and replaced with new fluid packings 19.

A handle 14 of the provision element 12 enables a particularly simple handling of the distributor apparatus 10. Control elements and/or operating elements for a conveying element 16 of the distributor apparatus 10 can, for example, be arranged in these handles 14. A particularly simple operation of the distributor apparatus can thereby be made possible. Via the conveying element 16, the fluid 70 can be urged from the fluid containers 18 into the distributor head 20 and can be distributed from distributor openings 60 onto a surface 80 (see FIGS. 6 and 7). The conveying element 16 can in particular, for example, have an electric motor for conveying the fluid 70. A pneumatic or hydraulic drive as part of the conveying element 16 is also possible. Furthermore, a manually driven, purely mechanical conveying element 16 is also conceivable. The different embodiments of a conveying element 16 preferably each have pistons that are guided in the fluid containers 18 and that urge the fluid 70 out of the fluid containers 18. The conveying element 16 often also has a drive rod (see FIG. 6) that is coupled to two drive rods, which each project into the fluid containers 18 or the hollow reception tubes and which are connected to the pistons, in order ultimately to transmit the movement of a drive of the conveying element 16, for example of an electric motor, to the pistons.

Figure 2:
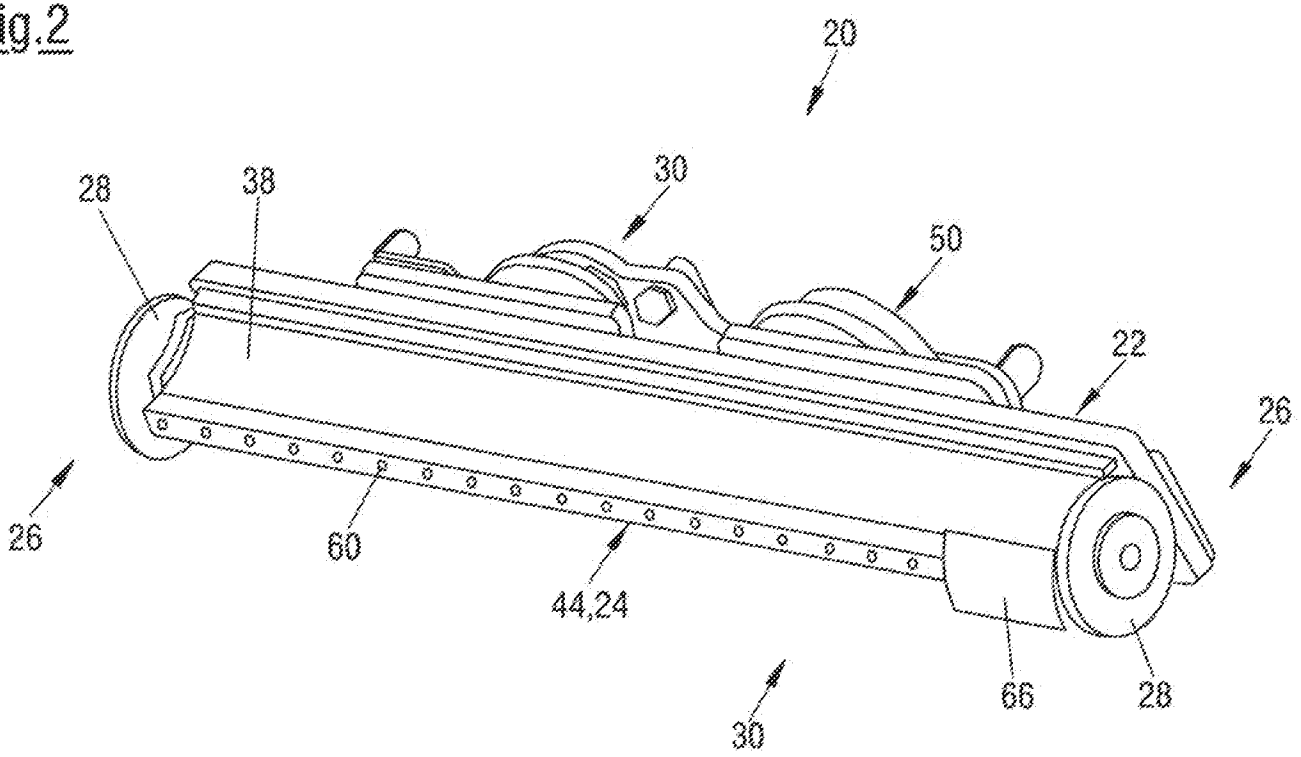
FIG. 2 is a distributor head in accordance with an embodiment of the invention.

A distributor head 20 is shown enlarged in FIG. 2. The distributor head 20 comprises a base element 30 that has an at least substantially triangular cross-section 36 (see FIG. 7). Two filling openings 50, which can be connected in a fluid-communicating manner to the fluid containers 18 (not shown) shown in FIG. 1, are arranged in a first longitudinal side 22 of the distributor head 20 that is formed by the rear side of the base element 30. The fluid 70 (see FIGS. 6 and 7) from the fluid containers 18 is distributed in the interior of the base element 30 and is distributed on a surface 80 (see FIGS. 6 and 7) via a plurality of distributor openings 60 that are arranged in a second longitudinal side 24 of the distributor head 20.

In this embodiment, the second longitudinal side 24 is arranged in a connection region 44 of a first wall element 38 and of a second wall element 40, not shown (see FIGS. 4A, 4B, 5A, 5B and 7). Rotatably supported spacer elements 28, which at least project over the second longitudinal side 24, are preferably arranged at opposite end sections 26 of the distributor head 20. Due to the spacer element 28, a spacing between the surface 80 and the distributor openings 60 can be ensured on the placement of the distributor head 20 on the surface 80. Furthermore, the distributor head 20 in accordance with an embodiment of the invention can have a closure element 66 which is preferably movable and by which individual distributor openings 60 can selectively be closed.

Figure 3:
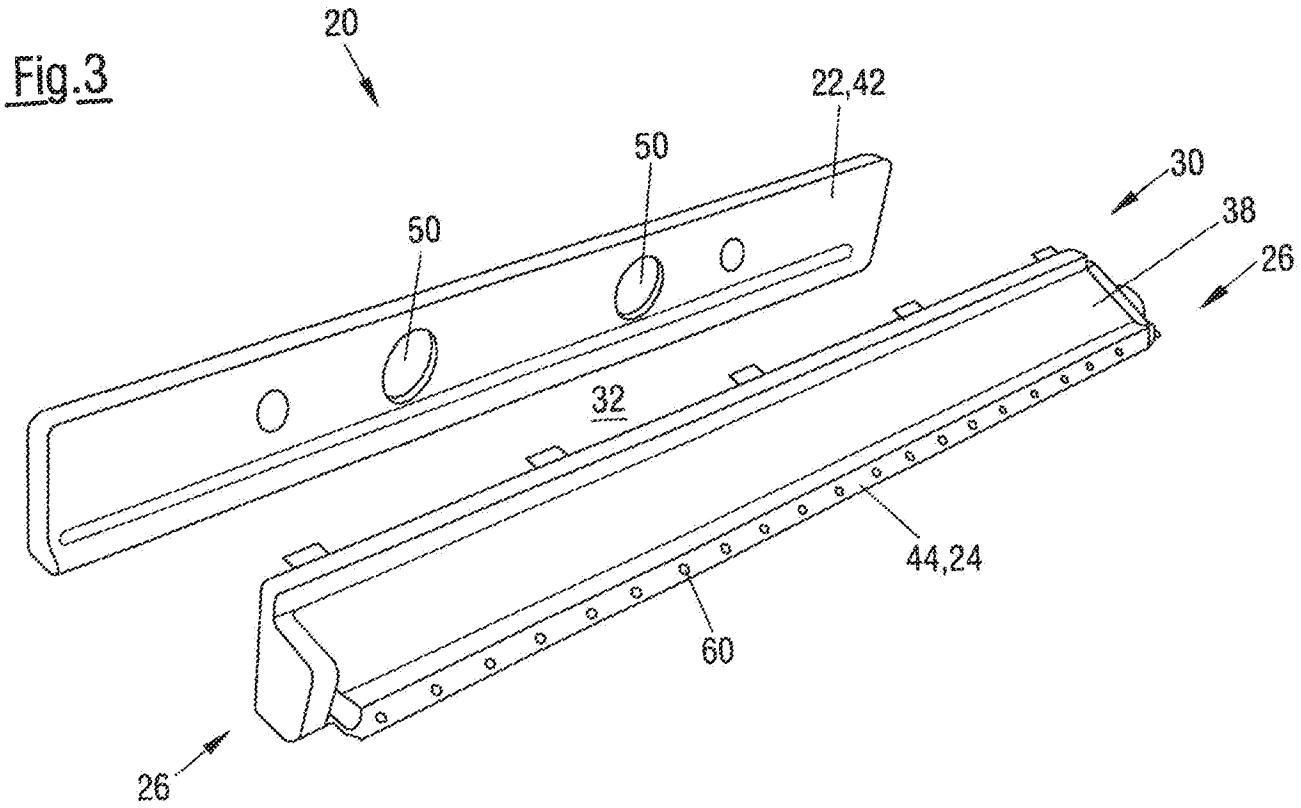
FIG. 3 is a distributor head in accordance with an embodiment of the invention in an exploded representation.

FIG. 3 shows the distributor head 20 shown in FIG. 2 in an exploded representation. It is clearly visible that the first longitudinal side 22 in this embodiment of the distributor head 20 in accordance with the invention is formed by a third wall element 42, wherein the two filling openings 50 are located spaced apart from one another substantially centrally in this third wall element 42. The third wall element 42 can preferably be arranged sealed at the first wall element 38 and at the non-visible second wall element 40 in order to enclose the fluid volume 32.

The first wall element 38 and the second wall element 40 are formed in one piece, preferably monolithically, wherein the distributor openings 60 necessary for discharging the fluid 70 are in turn arranged in their connection region 44. In other words, a second longitudinal side 24 of the distributor head 20 in accordance with the invention is formed by the connection region 44. The first wall element 38 and the second wall element 40 can in particular be composed of plastic and can preferably be manufactured as an injection-molded part. The third wall element 42 can in particular also be composed of plastic and can preferably be manufactured as an injection-molded part.

FIGS. 4A, 4B, 5A and 5B show two possible embodiments of a distributor head 20 in accordance with embodiments of the invention in which the principle in accordance with embodiments of the invention of varying a length 62 and/or a width 64 of the respective distributor openings 60 is implemented differently in each case. Both embodiments agree to the extent that the fluid volume 32 here also has an at least substantially triangular cross-section 36 (see FIG. 7), wherein only the first wall element 38 and the second wall element 40 connected in one piece and/or monolithically thereto are shown in each case. The fluid volume 32 in particular extends within the base element 30 of the distributor head 20 between the two end sections 26 of the distributor head 20.

Furthermore, in both embodiments of the distributor head 20 in accordance with the invention, provision is made such that the distributor openings 60 are each arranged in a wall 34 of the base element 30, wherein this wall 34 extends in the connection region 44 between the first wall element 38 and the second wall element 40 as the second longitudinal side 24 of the distributor head 20. Furthermore, the filling openings 50 are indicated in each of the two Figures.

Figure 4A:
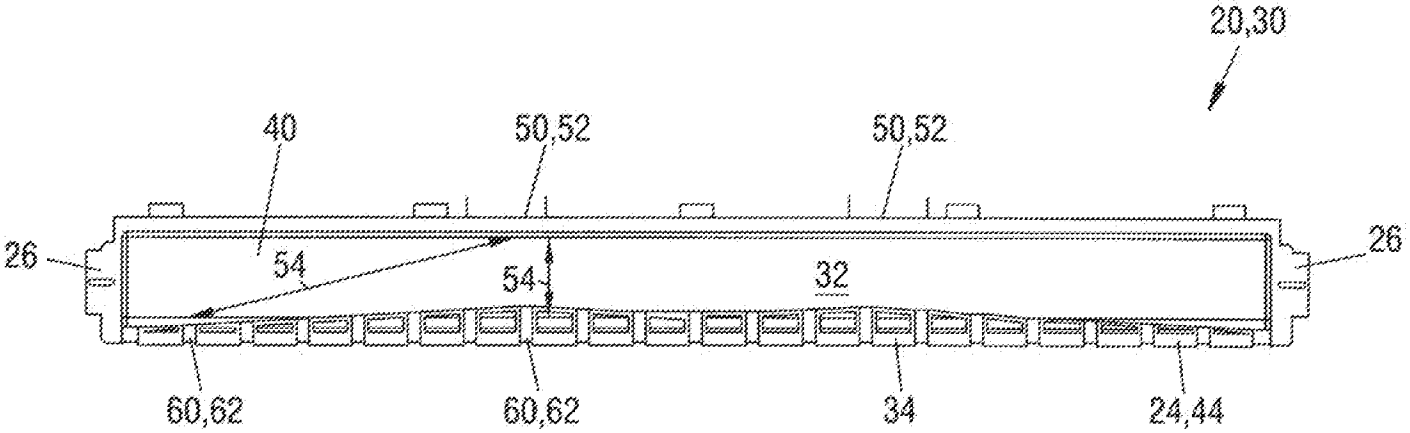
FIGS. 4A and 4B illustrate a first embodiment of distributor openings in a distributor head in accordance with the invention.
Figure 4B:
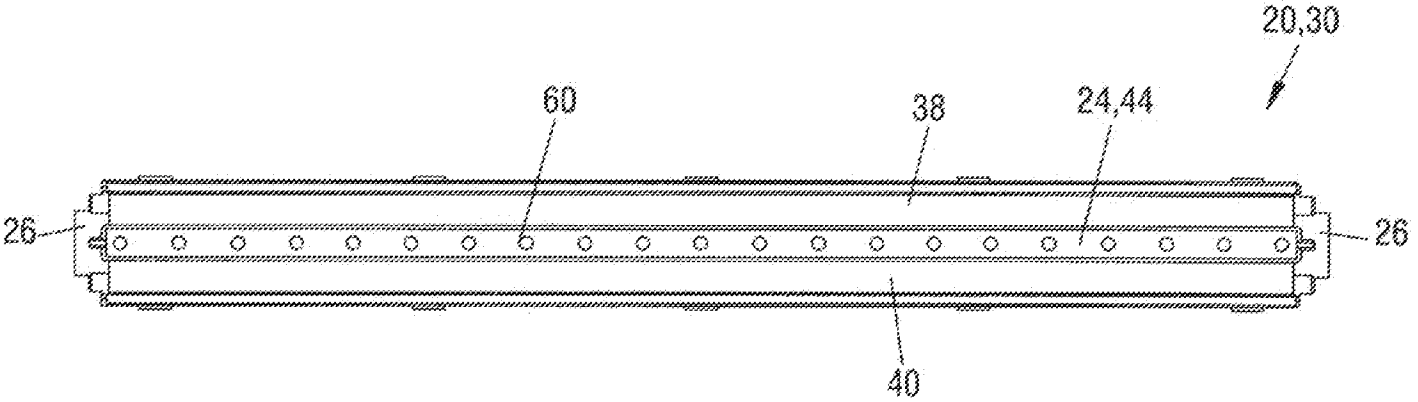

In FIGS. 4A and 4B, an embodiment of a distributor head 20 in accordance with the invention is shown in which in particular the lengths 62 of the distributor opening 60 are formed in a varying manner adapted to the respective position 52 of the filling openings 50. It is clearly visible that in particular the lengths 62 of the distributor openings 60 decrease as the spacing 54 from the respective filling openings 50 increases. In other words, the distributor openings 60 that are disposed closer to the filling openings 50 have a larger length 62 than the distributor openings 60 that are disposed further remote from the filling openings 50. Expressed differently, distributor openings 60 having a larger length 62 are provided in regions of the fluid volume 32 in which the fluid 70 (not shown) is present at a high pressure due to the position 52 of the filling openings 50 rather than in regions further remote from the filling openings 50 at which distributor openings having a smaller length 62 are arranged in the wall 34. A compensation of the different pressure ratios in the fluid 70 in the fluid volume 32 can be achieved in this manner. Furthermore, it is particularly easily apparent that if two filling openings 50 are provided as in the embodiment shown, this is also reflected in the lengths 62 of the distributor openings 60 or their variation.

Figure 5A:
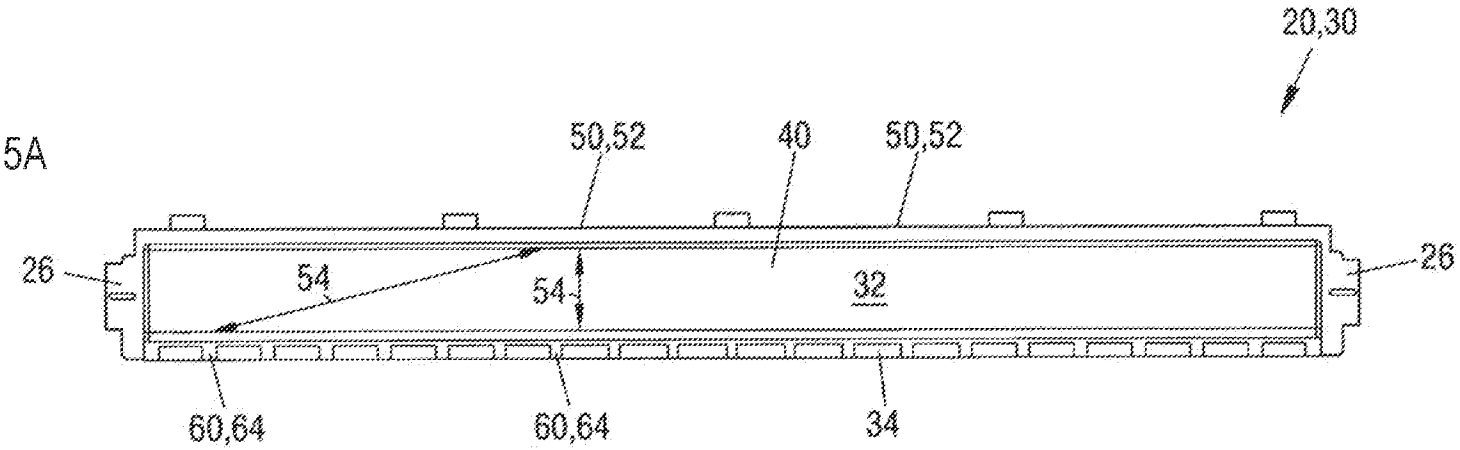
FIGS. 5A and 5B illustrate a second embodiment of distributor openings in a distributor head in accordance with the invention.
Figure 5B:
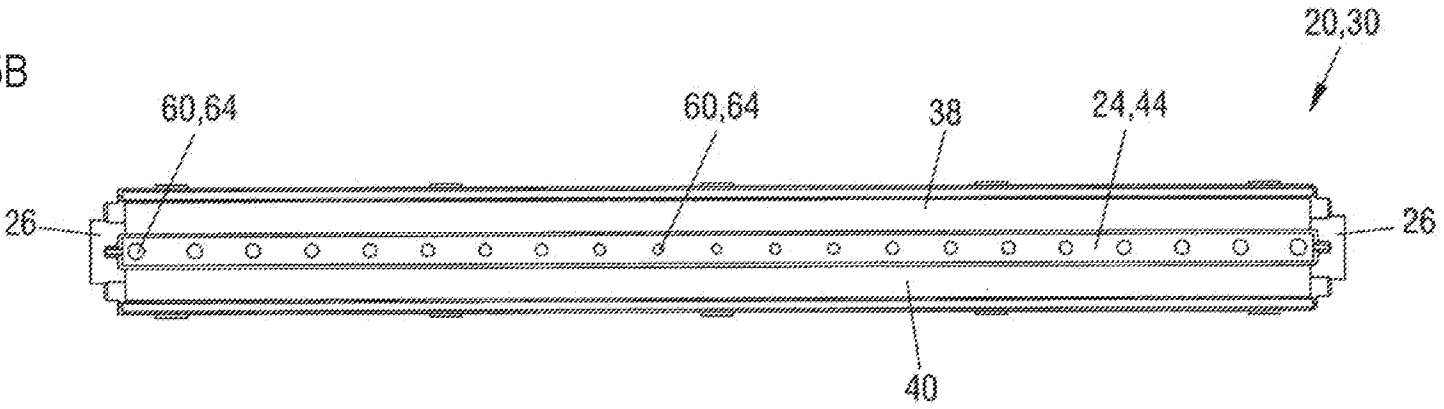

In an alternative or additional embodiment of a distributor head 20 in accordance with the invention, the above-described differences in the effective pressure of the fluid 70 in the fluid volume 32 can also be compensated by a variation of the width 64 of the distributor openings 60. This is shown in FIGS. 5A and 5B, wherein it is in particular visible that the widths 64 of the distributor openings 60 likewise increase as the spacing 54 from the filling openings 50 increases. It is also visible here that the presence of two filling openings 50 is likewise reflected in the variation of the width 64 of the distributor openings 60.

Figure 6:
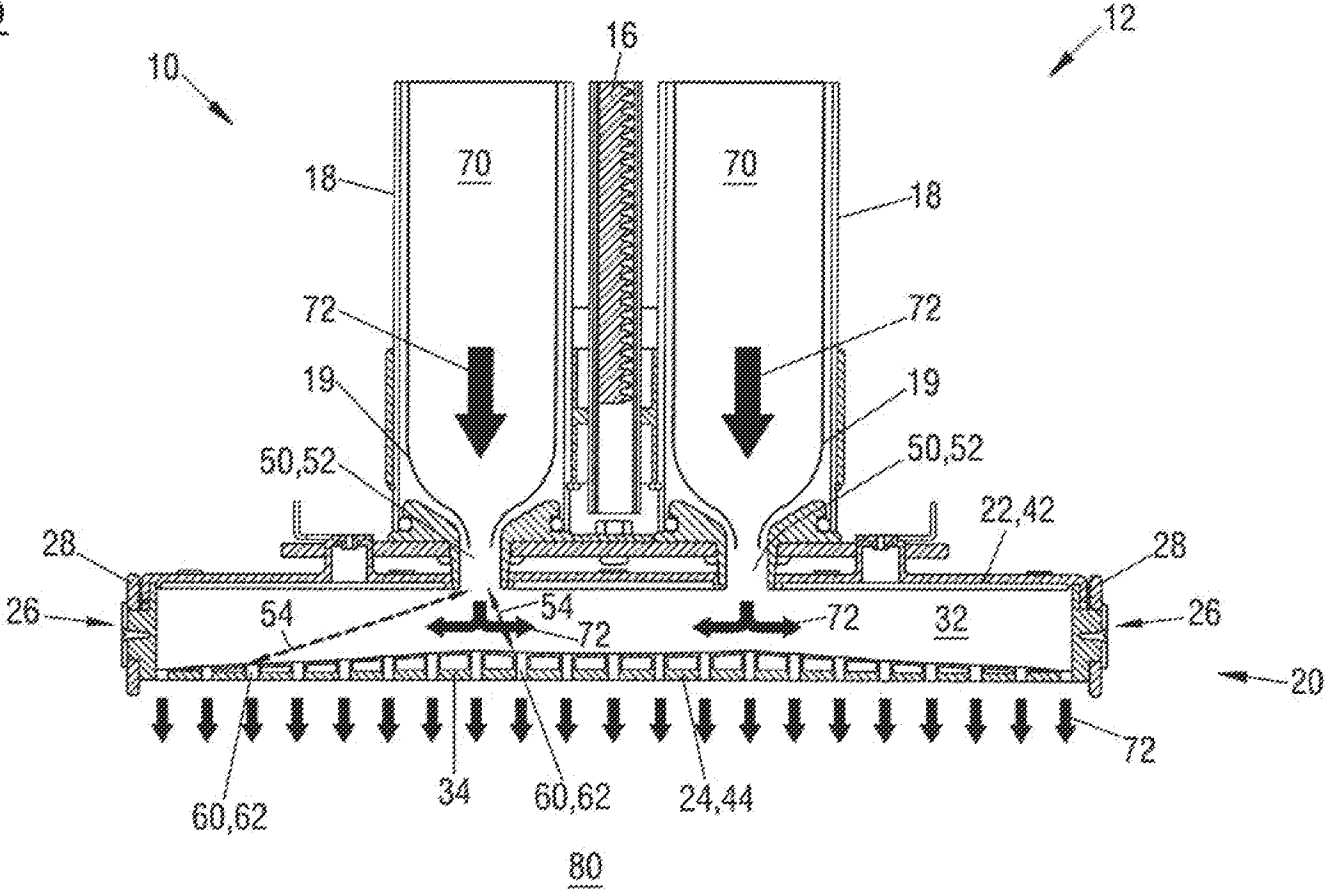
FIG. 6 is a sectional representation through a distributor apparatus in accordance with an embodiment of the invention on the distribution of a fluid.

FIG. 6 shows a distributor apparatus 10 in accordance with the invention on the distribution of a fluid 70 onto a surface 80. The distributor openings 60 are arranged in a connection region 44 that is disposed opposite the first longitudinal side 22 of the distributor head 20 that is formed by the third wall element 42. Rotatably supported spacer elements 28 are again arranged at end sections 26 of the distributor head 20, whereby a uniform application or movement of the total distributor apparatus 10 can be particularly easily achieved on the application of the fluid 70 to the surface 80. The fluid 70 is pressed from the two fluid packings 19, which are arranged in the fluid containers 18 and which are configured as flexible bags, into the fluid volume 32 of the base element 30 via a conveying element 16 of the provision element 12 of which only a drive rod is visible in this Figure. For this purpose, the base element 30 is connected in a fluid-communicating manner to the two fluid containers 18 via the two filling openings 50. On the entry into the fluid volume 32, the fluid 70 is distributed in this fluid volume 32 along a flow direction 72. In this respect, it is recognizable that the flow direction 72 of the fluid 70 in the fluid volume 32 near the filling openings 50 at least substantially faces in the direction of the distributor openings 60, but is oriented transversely thereto further remote from the filling openings 50. It thereby becomes clear that a higher effective pressure is adopted in the fluid 70 near the position 52 of the filling openings 50 than remote from this position 52. As described above with respect to FIGS. 4A and 4B, the lengths 62 of the distributor openings 60 provided in the second longitudinal side 24 of the distributor head 20 are therefore formed as varying depending on the spacing 54 of the respective distributor opening 60 from the position 52 of the filling opening 50.

Figure 7:
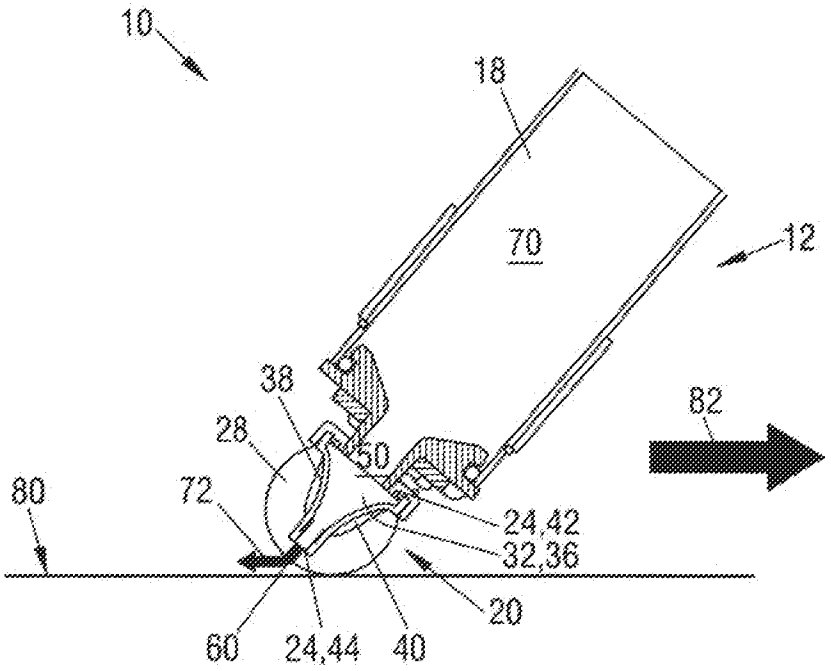
FIG. 7 is a further sectional representation of a distributor apparatus in accordance with an embodiment of the invention on the distribution of a fluid.

A further sectional representation of a distributor apparatus 10 in accordance with an embodiment of the invention on the application of a fluid 70 in a flow direction 72 to a surface 80 is shown in FIG. 7. On the application of the fluid 70 to the surface 80, the total distributor apparatus 10 moves in a distribution direction 82, wherein this is made possible particularly easily by the rotatably supported spacer elements 28. The fluid 70 is introduced from the fluid containers 18 via the filling opening 50 into the fluid volume 32 of the distributor head 20 and leaves the latter along the flow direction 72 through the plurality of distributor openings 60 that are provided in the second longitudinal side 24 of the distributor head 20 that is configured as a connection region 44. In this sectional representation, it is particularly clearly visible that the base element 30, and thus also the fluid volume 32, has a triangular or at least substantially triangular cross-section 36. This cross-section 36 is in particular formed by the first wall element 38 and the second wall element 40 formed in one piece and/or monolithically therewith. The first and second wall elements 38, 40 close the connection region 44 that forms the second longitudinal side 24 of the distributor head 20 and in particular supports the plurality of distributor openings 60. The third wall element 42 is arranged opposite the connection region 44 and, as the first longitudinal side 22 of the distributor head 20, is in turn used for arranging the filling opening 50.

While the embodiment example shown in the Figures has two fluid containers 18 arranged in parallel next to one another, a distributor head 20 in accordance with the invention can naturally also only be connected to a single fluid container 18 or to more than two fluid containers 18. Such a distributor head and such a distributor apparatus are also within the scope of the present invention and have the advantages mentioned with reference to the embodiment example described. All the structural and functional features described are also applicable in such modifications.

Figure 8:
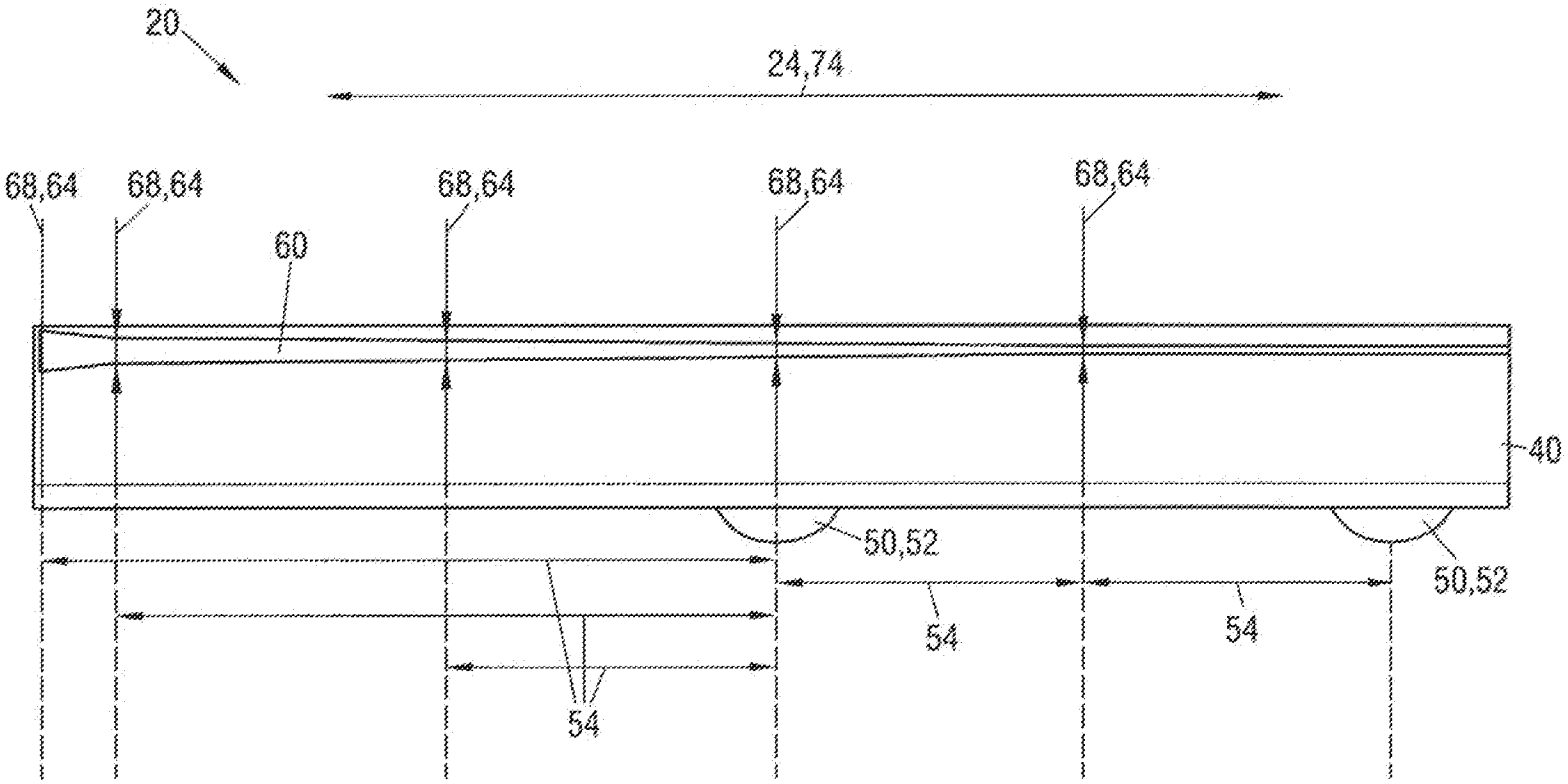
FIG. 8 is a part view of a distributor head in accordance with an embodiment of the invention with a slot-like distributor opening.

A further embodiment of a distributor head 20 in accordance with the invention is shown in FIG. 8. In this embodiment, the distributor head 20 is equipped with a single distributor opening 60, wherein this distributor opening 60 is slot-like and extends over the total or at least substantially the total second longitudinal side 24 in its longitudinal direction 74. It is clearly visible that this distributor opening 60 has a width 64 that is variably formed along the longitudinal direction 74. Overall, the width 64 of the slot-like distributor opening 60 increases as the spacing 54 from the two filling openings 50 or their positions 52 increases. The inner differences of the fluid 70 to be distributed in the fluid volume 32 of the distributor head 20 that have already been described above can also be at least partly compensated, preferably completely compensated, in this manner. A uniform discharge of the fluid 70 onto a surface 80 can thus also be provided with a correspondingly designed slot-like distributor opening 60.

Figure 9:
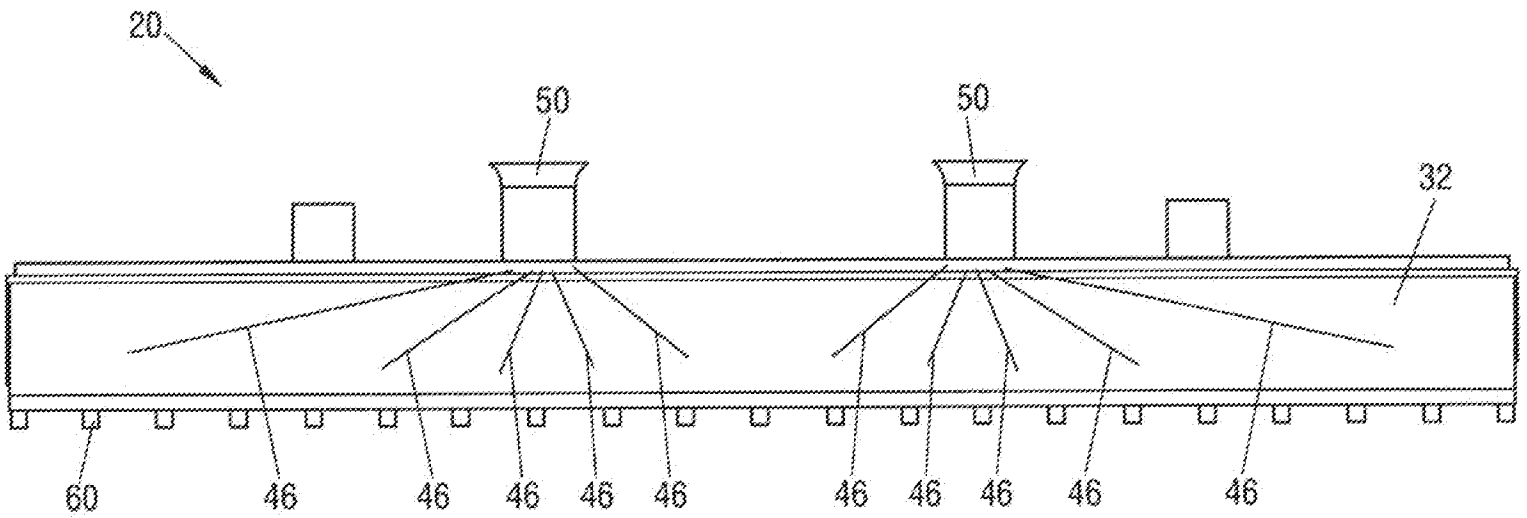
FIG. 9 is a sectional representation of a distributor head in accordance with an embodiment of the invention with distribution elements.

FIG. 9 shows an alternative or additional embodiment of an inner design of a distributor head 20 in accordance with the invention in a sectional representation. This distributor head 20 also has two filling openings 50 and a plurality of distributor openings 60. In order already to be able to provide as uniform as possible a distribution of the fluid 70 in the fluid volume 32 of the distributor head 20, guide elements 46 are arranged in this embodiment of the distributor head 20 in accordance with the invention. As shown, these guide elements 46 can, for example, be configured as guide surfaces that preferably start in a ray-like manner from the respective filling openings 50. A uniform distribution of the fluid 70 can already be achieved or at least supported within the fluid volume 32 in this manner. A discharge of the fluid 70 through the plurality of distributor openings 60 can then take place uniformly over the total width of the distributor head 20 in a particularly simple manner.

The invention claimed is:

1. A distributor head for a distributor apparatus for distributing fluid onto a surface, the distributor head comprising:

an elongate base element having a fluid volume to receive the fluid;

a filling opening connected in a fluid-communicating manner to the fluid volume to fill the fluid into the fluid volume; and a plurality of distributor openings connected in a fluid-communicating manner to the fluid volume to distribute the fluid from the fluid volume, the filling opening arranged at a first longitudinal side of the distributor head and the plurality of distributor openings arranged at a second longitudinal side of the distributor head, the first longitudinal side arranged opposite the second longitudinal side, the plurality of distributor openings continuously formed in a wall of the base element such that a first open end of a respective distributor opening of each of the plurality of distributor openings connected in a fluid-communicating manner to the fluid volume and a second open end of the respective distributor opening is connected in a fluid-communicating manner to an environment of the distributor head, the plurality of distributor openings arranged adjacent to one another, the plurality of distributor openings are each formed with a defined length and a defined width, and the defined lengths of the plurality of distributor openings along a flow direction of the fluid or the defined widths of the distributor openings transverse to the flow direction of the fluid are formed in a varying manner over the plurality of distributor openings for a uniform fluid distribution on the surface upon the distribution of the fluid, or at least one of the plurality of distributor openings being a slot-like distributor opening, the slot-like distributor opening extending along a longitudinal direction of the second longitudinal side and a length of the slot-like distributor opening along a flow direction of the fluid or a width of the slot-like distributor opening transverse to the flow direction of the fluid and transverse to the longitudinal direction of the second longitudinal side is formed in a varying manner for a uniform fluid distribution on the surface upon the distribution of the fluid, or distribution elements for a uniform distribution of the fluid in the fluid volume arranged in the fluid volume for a uniform fluid distribution on the surface upon the distribution of the fluid through the plurality of distributor openings, and the base element having a triangular cross-section transverse to the first longitudinal side or the second longitudinal side, and the base element has a first wall element, a second wall element, and a third wall element, the first, second and third wall elements being elongate and arranged abutting one another to form the triangular cross-section of the base element.

2. The distributor head in accordance with claim 1, wherein the length or the width of each of the plurality of distributor openings varies based on a position relative to the filling opening.

3. The distributor head in accordance with claim 1, wherein the length or the width of each of the plurality of distributor openings varies based on a spacing between the filling opening and a respective distributor opening.

4. The distributor head in accordance with claim 1, wherein the lengths of the each of the plurality distributor openings decreases as a spacing between the filling opening and a respective distributor opening increases.

5. The distributor head in accordance with claim 1, wherein the widths of each of the plurality of distributor openings increases as a spacing between the at least one filling opening and a respective distributor opening increases.

6. The distributor head in accordance with claim 1, the filling opening is one of a plurality of filling openings, and the plurality of filling openings are arranged in the first longitudinal side of the distributor head.

7. The distributor head in accordance with claim 1, further comprising two mutually opposite end sections at a termination of the first longitudinal side and the second longitudinal side, a disk-like spacer element arranged at each of the end sections, and the disk-like spacer elements at least project over the second longitudinal side of the distributor head.

8. The distributor head in accordance with claim 7, wherein each of the disk-like spacer elements is arranged in a rotatably supported manner at a respective end section.

9. The distributor head in accordance with claim 1, further comprising a closure element for selectively at least partly closing at least one of the plurality of distributor openings.

10. A distributor apparatus for distributing fluid onto a surface, comprising:

a distributor head in accordance with claim 1; and a provision element configured to provide the fluid, the provision element connected in a fluid-communicating manner to the filling opening of the distributor head.

11. The distributor head in accordance with claim 10, wherein the distributor head is configured to distribute liquid adhesives or adhesive agents onto a substrate surface.

12. The distributor apparatus in accordance with claim 1, wherein the distributor head is configured to distribute liquid adhesives or adhesive agents onto a substrate surface.

13. The distributor head in accordance with claim 1, wherein the base element has a first wall element, a second wall element, and a third wall element, the first, second and third wall elements being elongate and connected to one another to form the triangular cross-section of the base element.

14. A distributor head for a distributor apparatus for distributing fluid onto a surface, the distributor head comprising:

an elongate base element having a fluid volume to receive the fluid;

a filling opening connected in a fluid-communicating manner to the fluid volume to fill the fluid into the fluid volume; and a plurality of distributor openings connected in a fluid-communicating manner to the fluid volume to distribute the fluid from the fluid volume, the filling opening arranged at a first longitudinal side of the distributor head and the plurality of distributor openings arranged at a second longitudinal side of the distributor head, the first longitudinal side arranged opposite the second longitudinal side, the plurality of distributor openings continuously formed in a wall of the base element, a first open end of a respective distributor opening of each of the plurality of distributor openings connected in a fluid-communicating manner to the fluid volume and a second open end of the respective distributor opening is connected in a fluid-communicating manner to an environment of the distributor head, the plurality of distributor openings arranged adjacent to one another, the plurality of distributor openings are each formed with a defined length and a defined width, and the defined lengths of the plurality of distributor openings along a flow direction of the fluid or the defined widths of the distributor openings transverse to the flow direction of the fluid are formed in a varying manner over the plurality of distributor openings for a uniform fluid distribution on the surface upon the distribution of the fluid, or at least one of the plurality of distributor openings being a slot-like distributor opening, the slot-like distributor opening extending along a longitudinal direction of the second longitudinal side and a length of the slot-like distributor opening along a flow direction of the fluid or a width of the slot-like distributor opening transverse to the flow direction of the fluid and transverse to the longitudinal direction of the second longitudinal side is formed in a varying manner for a uniform fluid distribution on the surface upon the distribution of the fluid, or distribution elements for a uniform distribution of the fluid in the fluid volume arranged in the fluid volume for a uniform fluid distribution on the surface upon the distribution of the fluid through the plurality of distributor openings, and the base element having triangular cross-section transverse to the first longitudinal side or the second longitudinal side, and the base element has a first wall element, a second wall element, and a third wall element, the first, second and third wall elements being elongate and connected to one another to form the triangular cross-section of the base element.

15. The distributor head in accordance with claim 14, wherein the first, second and third wall elements being elongate and arranged abutting one another to form the triangular cross-section of the base element.

16. The distributor head in accordance with claim 15, wherein the first wall element and the second wall element are formed in one piece or monolithically and separately from the third wall element.

17. The distributor head in accordance with claim 15, wherein the third wall element is connectable in a sealed manner to the first wall element and the second wall element to form the fluid volume.

18. The distributor head in accordance with claim 15, wherein the third wall element forms the first longitudinal side of the distributor head, or the filling opening is arranged in the third wall element.

19. The distributor head in accordance with claim 15, wherein a connection region between the first wall element and the second wall element forms the second longitudinal side of the distributor head, and the plurality of distributor openings is arranged in the connection region.

* * * * *